US010490959B2

(12) United States Patent
Huang et al.

(10) Patent No.: US 10,490,959 B2
(45) Date of Patent: Nov. 26, 2019

(54) ELECTRICAL RECEPTACLE CONNECTOR WITH EMBEDDED MEMBER FOR POSITIONING CONDUCTIVE SUBSTRATE

(71) Applicant: ADVANCED-CONNECTEK INC., New Taipei (TW)

(72) Inventors: Fan-Cheng Huang, New Taipei (TW); Ying-Te Lin, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/206,441

(22) Filed: Nov. 30, 2018

(65) Prior Publication Data

US 2019/0165526 A1 May 30, 2019

(30) Foreign Application Priority Data

Nov. 30, 2017 (TW) ..... 106217867 U

(51) Int. Cl.
*H01R 13/648* (2006.01)
*H01R 24/62* (2011.01)
*H01R 13/6585* (2011.01)

(52) U.S. Cl.
CPC ..... *H01R 24/62* (2013.01); *H01R 13/6585* (2013.01)

(58) Field of Classification Search
CPC .. H01R 23/7073; H01R 12/79; H01R 23/688; H01R 13/7197; H01R 23/6873; H01R 13/514
USPC ..... 439/607.05, 607.09, 607.1, 607.12, 439/607.13, 607.15, 607.53, 492, 493, 79
See application file for complete search history.

(56) References Cited

U.S. PATENT DOCUMENTS

| | | | | |
|---|---|---|---|---|
| 7,758,374 | B2 * | 7/2010 | Yu | H01R 4/027 439/493 |
| 9,022,800 | B2 * | 5/2015 | Yang | H01R 13/6581 439/487 |
| 9,590,364 | B1 * | 3/2017 | Chang | H01R 13/6581 |
| 9,647,377 | B1 * | 5/2017 | Peng | H01R 13/405 |
| 9,728,899 | B2 * | 8/2017 | Peng | H01R 13/6581 |
| 10,084,256 | B2 * | 9/2018 | Zhao | H01R 13/6585 |
| 10,116,100 | B2 * | 10/2018 | Feng | H01R 13/6596 |
| 10,276,982 | B2 * | 4/2019 | Feng | H01R 13/6593 |

* cited by examiner

*Primary Examiner* — Thanh Tam T Le
(74) *Attorney, Agent, or Firm* — Muncy, Geissler, Olds & Lowe, P.C.

(57) ABSTRACT

An electrical receptacle connector is provided for contacting conductive surfaces of a conductive substrate. The connector includes an insulated housing out of a terminal retaining member and an outer shell enclosing the insulated housing. The outer shell includes two side plates extending toward two sides of a mount member at the rear portion of the insulated housing. The conductive substrate is inserted into the mount member and in contact with first receptacle terminals. An embedded member is inserted between the side plates for positioning the conductive substrate. Hence, the electrical receptacle connector can be connected with the conductive substrate without connecting to an additional FPC receptacle connector and additional terminals of the FPC connector. Consequently, a product with the connector can be assembled with flexible circuit board or flexible flat cables, and the circuit board or cable can be replaced easily when the board or the cable has defects.

11 Claims, 12 Drawing Sheets

ELECTRICAL RECEPTACLE CONNECTOR WITH EMBEDDED MEMBER FOR POSITIONING CONDUCTIVE SUBSTRATE

CROSS-REFERENCE TO RELATED APPLICATION

This non-provisional application claims priority under 35 U.S.C. § 119(a) to Patent Application No. 106217867 in Taiwan, R.O.C. on Nov. 30, 2017, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. In general, the plastic core of the conventional connector is formed by several pieces of plastic components, while the upper and lower receptacle terminals are respectively assembled with the plastic components.

SUMMARY OF THE INVENTION

The conventional USB type-C receptacle connector includes terminals aligned in two lines. As a result, the conventional connector neither can be assembled with the flexible flat cable (FFC) nor the flexible printed circuit (FPC). Hence, the conventional USB type-C connector has to be assembled with a first adapter to be served as an ITC (or FFC) electrical connector, and the FPC (or FFC) connector is connected with the flexible printed circuit board (or flexible flat cable), then the circuit board or the flat cable is further adapted to be connected with different parts of a motherboard. Consequently, such connection is achieved by using three adapters and requires a higher cost.

In view of this, an embodiment of the instant disclosure provides an electrical receptacle connector, and the electrical receptacle connector is adapted to be in contact with a plurality of conductive surfaces of a conductive substrate. The electrical receptacle connector comprises a terminal module, an insulated housing, a plurality of first receptacle terminals, an outer shell, and an embedded member. The insulated housing is formed out of the terminal retaining member. The insulated housing comprises a base portion and a tongue portion. The base portion is extending from one of two ends of the base portion, and a mount member is assembled at the other end of the base portion. Each of the first receptacle terminals comprises a first flat contact portion, a first body portion, and a first tail portion. Each of the first flat contact portions is extending forward from the first body portion in the rear-to-front direction and on a first surface of the terminal retaining member. Each of the first tail portions is extending backward from the first body portion in the front-to-rear direction and extending out of the base portion. The first tail portions are on the mount member and in contact with the conductive surfaces. The outer shell encloses out of the base portion. The outer shell comprises two side plates extending toward two sides of the base portion. Each of the side plates has a slidable groove. The embedded member is between the side plates and on the mount member. Two sides of the embedded member have two slidable blocks for engaging with the slidable grooves, respectively. A plurality of stopping blocks is extending outwardly from a bottom of the embedded member.

In one embodiment, each of the slidable grooves comprises a first groove and a second groove communicating with the first groove. A width of the first groove is greater than a width of the second groove, and a width of the slidable block is substantially equal to the width of the second groove.

In one embodiment, two buckling portions are outwardly protruding from two sides of the conductive substrate, and the stopping blocks of the embedded member are buckled with the buckling portions, respectively.

In one embodiment, a plurality of recesses is on a surface of the err bedded member.

In one embodiment, each of the first receptacle terminals comprises a first extending portion for adjusting a position of the corresponding first tail portion.

In one embodiment, the electrical receptacle connector further comprises a plurality of second receptacle terminals. Each of the second receptacle terminals comprises a second flat contact portion, a second body portion, and a second tail portion. Each of the second flat contact portions is extending forward from the second body portion in the rear-to-front direction and on a second surface of the terminal retaining member opposite to the first surface. Each of the second tail portions is extending backward from the second body portion in the front-to-rear direction and extending out of the base portion. The second tail portions are on the mount member and in contact with the conductive surfaces, and the first tail portions and the second tail portions are arranged in a same line.

In one embodiment, a plurality of fixing grooves is formed on a surface of the mount member, and the first tail portions and the second tail portions are held in the fixing grooves, respectively.

In one embodiment, each of the first tail portions has a first curved surface extending out of the corresponding fixing groove, and each of the second tail portions has a second curved surface extending out of the corresponding fixing groove.

In one embodiment, the electrical receptacle connector further comprises a plurality of shielding plates. The shielding plates are at two sides of the terminal retaining member, and the shielding plates are between the first receptacle terminals and the second receptacle terminals.

In one embodiment, the electrical receptacle connector further comprises a metallic shell. The metallic shell comprises a receptacle cavity for receiving the tongue portion.

Furthermore, when the terminal retaining member is formed in the first molding procedure, the first receptacle terminals are positioned on the first surface of the terminal retaining member and the second receptacle terminals are positioned on the second surface of the terminal retaining member. After the receptacle terminals are assembled with the terminal retaining member, the assembly is placed in the mold for a second molding procedure, so that the insulated housing is formed out of the terminal retaining member, and a semi-product of the connector can be thus obtained. As compared with the conventional, the molding times for the connector can be reduced, from three times to two times. Therefore, the difficulties in manufacturing the components of the connector and the cost for manufacturing the connector can be reduced, while the manufacturing efficiency of the connector can be improved. Moreover, in the second molding procedure, the first receptacle terminals and the second receptacle terminals are molded by the insulated housing. Therefore, the front ends of the receptacle terminals would not deflect upwardly when the connector is used for a period of time. Furthermore, the terminal retaining member is adapted to separate the first receptacle terminals, the second receptacle terminals, and the shielding plate to prevent interferences between the components.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
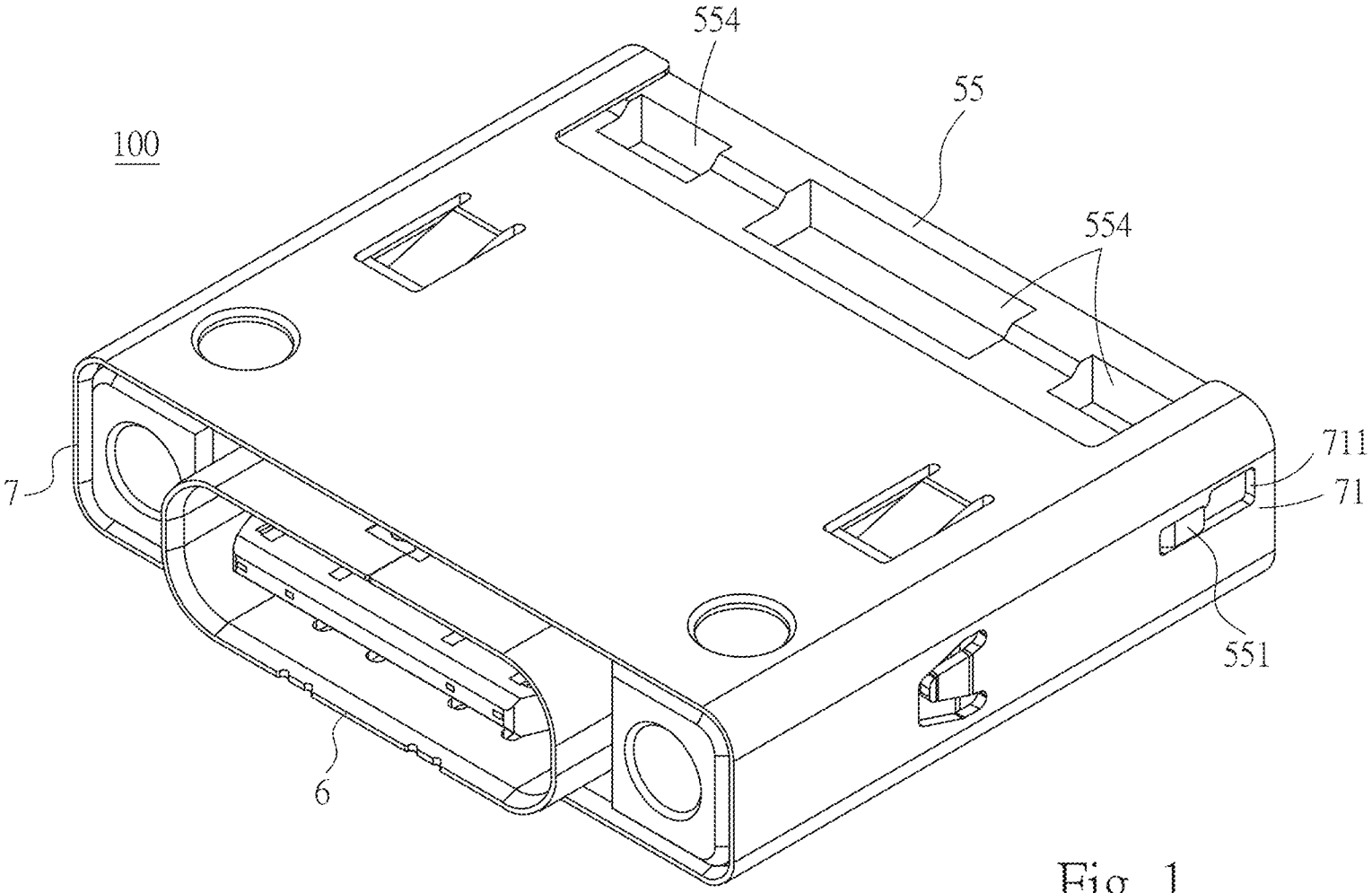
FIG. 1 illustrates a perspective view (1) of an electrical receptacle connector of an exemplary embodiment of the instant disclosure.
Figure 2:
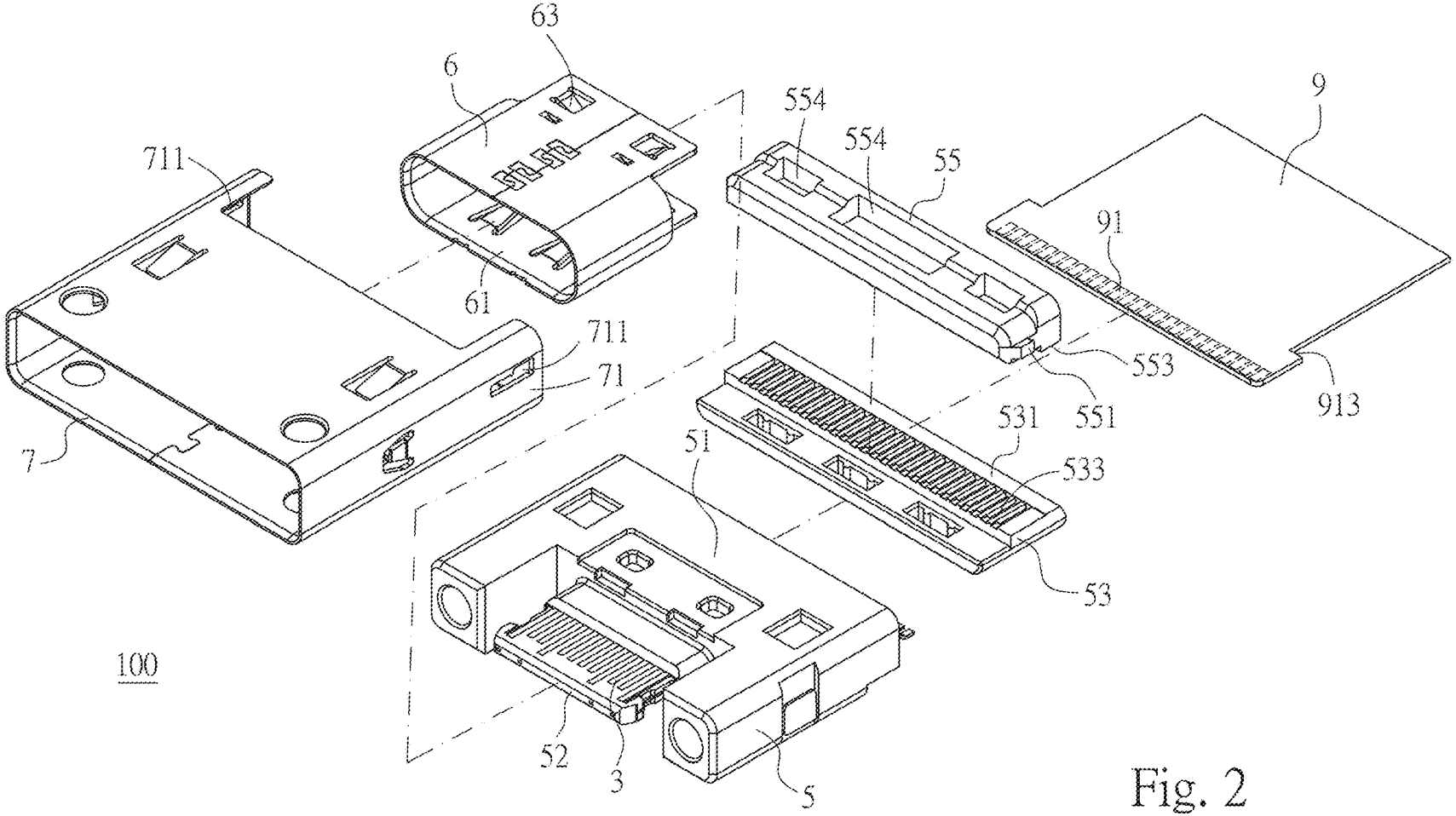
FIG. 2 illustrates an exploded view (1) of the electrical receptacle connector.
Figure 3:
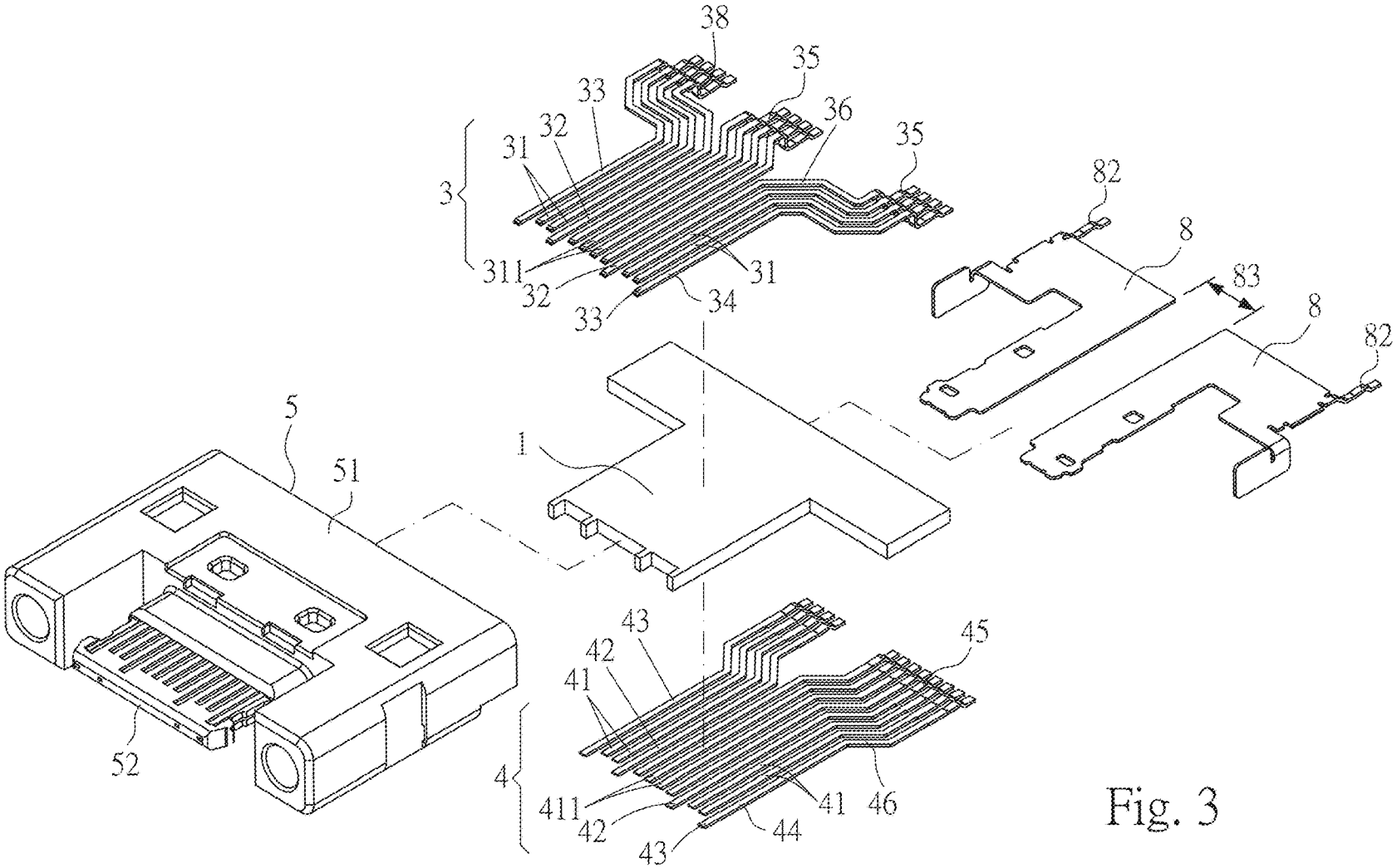
FIG. 3 illustrates an exploded view (2) of the electrical receptacle connector.

Please refer to FIGS. 1 and 3, illustrating an electrical receptacle connector 100 of an exemplary embodiment of the instant disclosure. FIG. 1 illustrates a perspective view (1) of an electrical receptacle connector 100 of the exemplary embodiment of the instant disclosure. FIG. 2 illustrates an exploded view (1) of the electrical receptacle connector 100. FIG. 3 illustrates an exploded view (2) of the electrical receptacle connector 100. In this embodiment, the terminal numbers of the electrical receptacle connector 100 meets the requirements for transmitting USB 3.0 signals, but embodiments are not limited thereto. In one embodiment, the terminal numbers of the electrical receptacle connector 100 may be adapted to meet the requirements for transmitting USB 2.0 signals, so that the electrical receptacle connector 100 is in compliance with the specification of a USB connection interface. In this embodiment, the electrical receptacle connector 100 is in compliance with the specification of a USB type-C connection interface, but embodiments are not limited thereto, the electrical receptacle connector 100 may be in compliance with the specification of an Micro USB or an HDMI connection interface. In this embodiment, the electrical receptacle connector 100 comprises a terminal retaining member 1, an insulated housing 5, a plurality of first receptacle terminals 3, a plurality of second receptacle terminals 4, an outer shell 7, and an embedded member 55.

Figure 4:
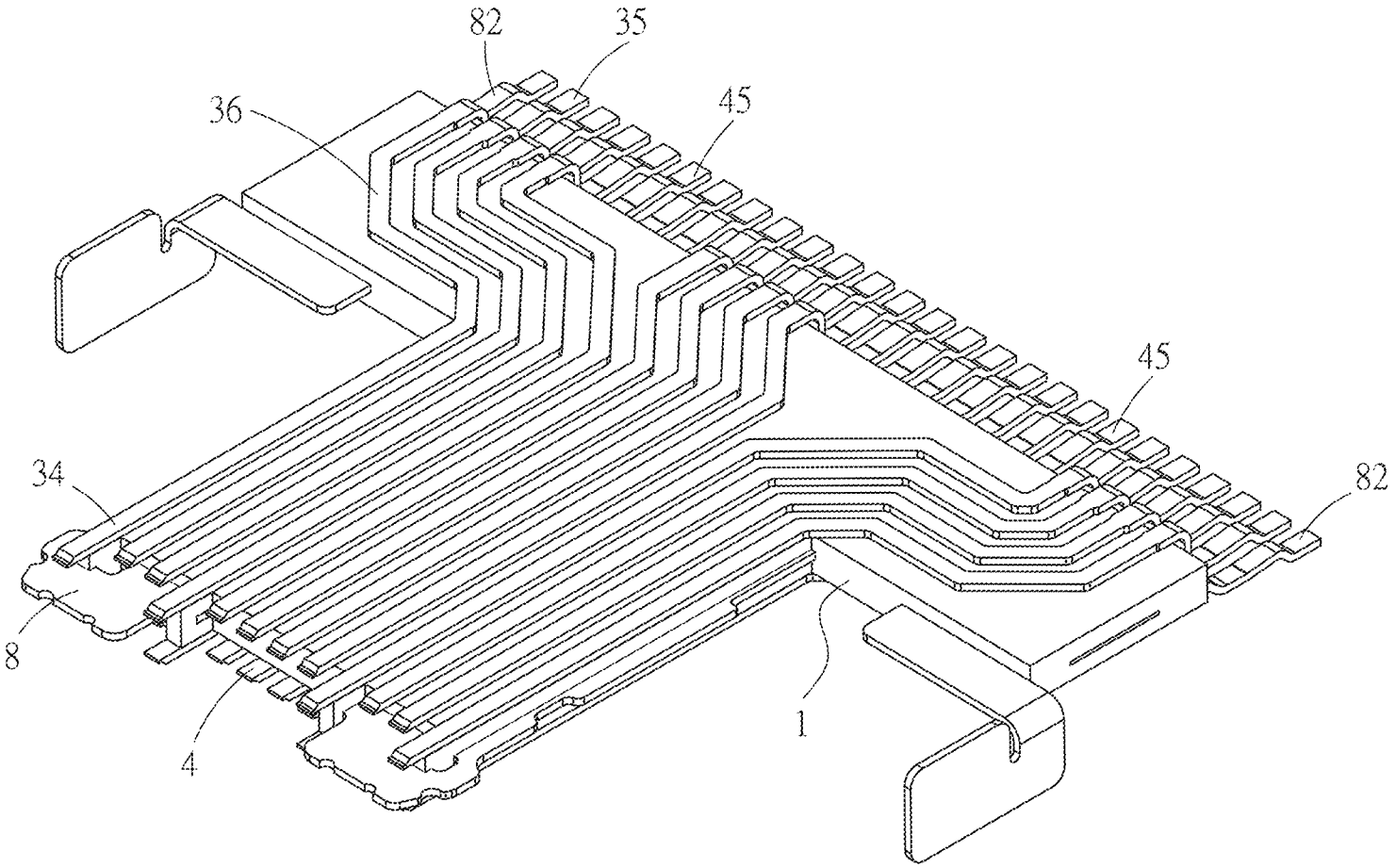
FIG. 4 illustrates a schematic view showing receptacle terminals stacked on an upper portion of a terminal retaining member.
Figure 5:
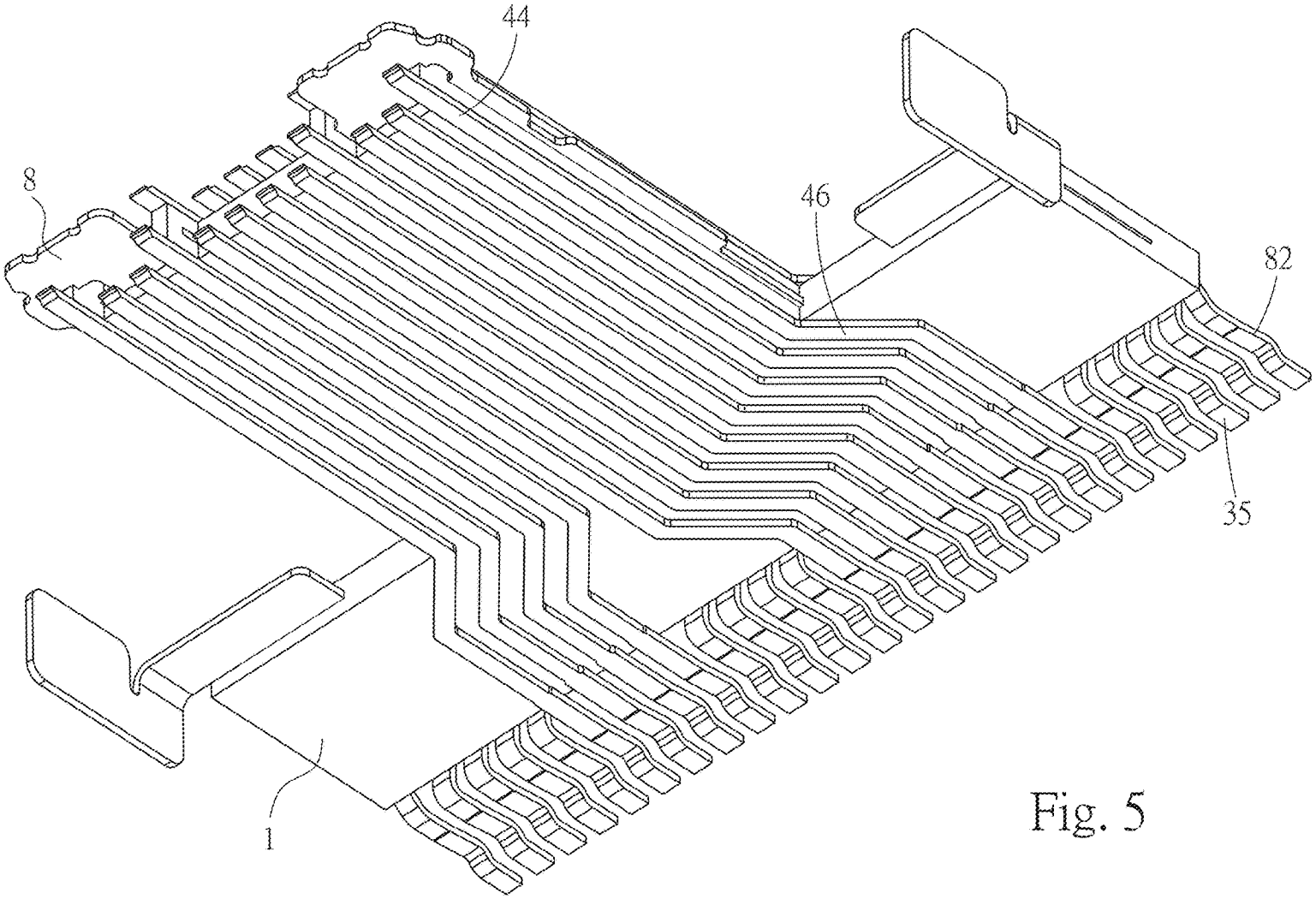
FIG. 5 illustrates a schematic view showing the receptacle terminals stacked on a lower portion of the terminal retaining member.

Please refer to FIGS. 1 to 5. FIG. 4 illustrates a schematic view showing receptacle terminals 3, 4 stacked on an upper portion of a terminal retaining member 1, and FIG. 5 illustrates a schematic view showing the receptacle terminals 3, 4 stacked on a lower portion of the terminal retaining member 1. In other words, in FIGS. 4 and 5, the terminal retaining member 1 is formed by a first molding procedure, and then the first receptacle terminals 3 and the second receptacle terminals 4 are respectively assembled at upper and lower portions of the terminal retaining member 1. In this embodiment, the terminal retaining member 1 is formed by the first molding procedure. The terminal retaining member 1 is a T-shaped plastic body, and an upper surface and a lower surface of the terminal retaining member 1 are flat surfaces.

Please refer to FIGS. 1 to 3. In this embodiment, the insulated housing 5 comprises a base portion 51 and a tongue portion 52. The tongue portion 52 is outwardly extending from one of two ends of the base portion 51. The tongue portion 52 has an upper surface and a lower surface opposite to the upper surface. The insulated housing 5 is formed out of the terminal retaining member 1. Moreover, a mount member 53 is outwardly extending from the other end of the base portion 51. The base portion 51 and the mount member 53 may be a unitary member or may be separated members.

Please refer to FIGS. 1 to 3. In this embodiment, the mount member 53 is outwardly extending from the base portion 51. The mount member 53 has a supporting surface 531 for positioning with a conductive substrate 9 (e.g., a flexible printed circuit or a flexible flat cable) after the conductive substrate 9 is inserted into the electrical receptacle connector 100. Therefore, the electrical receptacle connector 100 has a structure for mating with the conductive substrate 9 and thus become a composite electrical receptacle connector having the structures of an electrical receptacle connector and an FPC electrical receptacle connector (or an FTC electrical receptacle connector).

Please refer to FIGS. 1 to 5. The first receptacle terminals 3 are held in the base portion 51 and disposed at the upper surface of the tongue portion 52. The first receptacle terminals 3 comprise a plurality of first signal terminals 31, at least one power terminal 32, and at least one ground terminal 33. In this embodiment, the first receptacle terminals 3 are combined with a metallic belting to form a one-piece component for facilitating in stacking the first receptacle terminals 3 on a first surface of the terminal retaining member 1. After the insulated housing 5 is formed out of the terminal retaining member 1, the metallic belting connected with the first receptacle terminals 3 is then removed.

Please refer to FIGS. 1 to 5. The second receptacle terminals 4 are held in the base portion 51 and disposed at the lower surface of the tongue portion 52. The second receptacle terminals 4 comprise a plurality of second signal terminals 41, at least one power terminal 42, and at least one ground terminal 43. In this embodiment, the second receptacle terminals 4 are combined with a metallic belting to form a one-piece component for facilitating in stacking the second receptacle terminals 4 on a second surface of the terminal retaining member 1 opposite to the first surface. Similarly, after the insulated housing 5 is formed out of the terminal retaining member 1, the metallic belting connected with the second receptacle terminals 4 is then removed.

Please refer to FIG. 2. In this embodiment, the electrical receptacle connector 100 further comprises a metallic shell 6. The metallic shell 6 is a hollowed shell. The metallic shell 6 comprises a receptacle cavity 61, and the tongue portion 52 of the insulated housing 5 is received in the receptacle cavity 61. A plurality of buckling pieces 63 is inwardly extending toward the interior of the metallic shell 6 from upper and lower sides of the rear portion of the metallic shell 6 for engaging with upper and lower portions of the base portion 51.

Please refer to FIGS. 2 to 5. In this embodiment, a plurality of first abutting blocks and a plurality of second abutting blocks are extending from one end of the terminal retaining member 1. The first abutting blocks are abutted against bottoms of front ends of the first receptacle terminals 3, and the second abutting blocks are abutted against bottoms of front ends of the second receptacle terminals 4.

Figure 6:
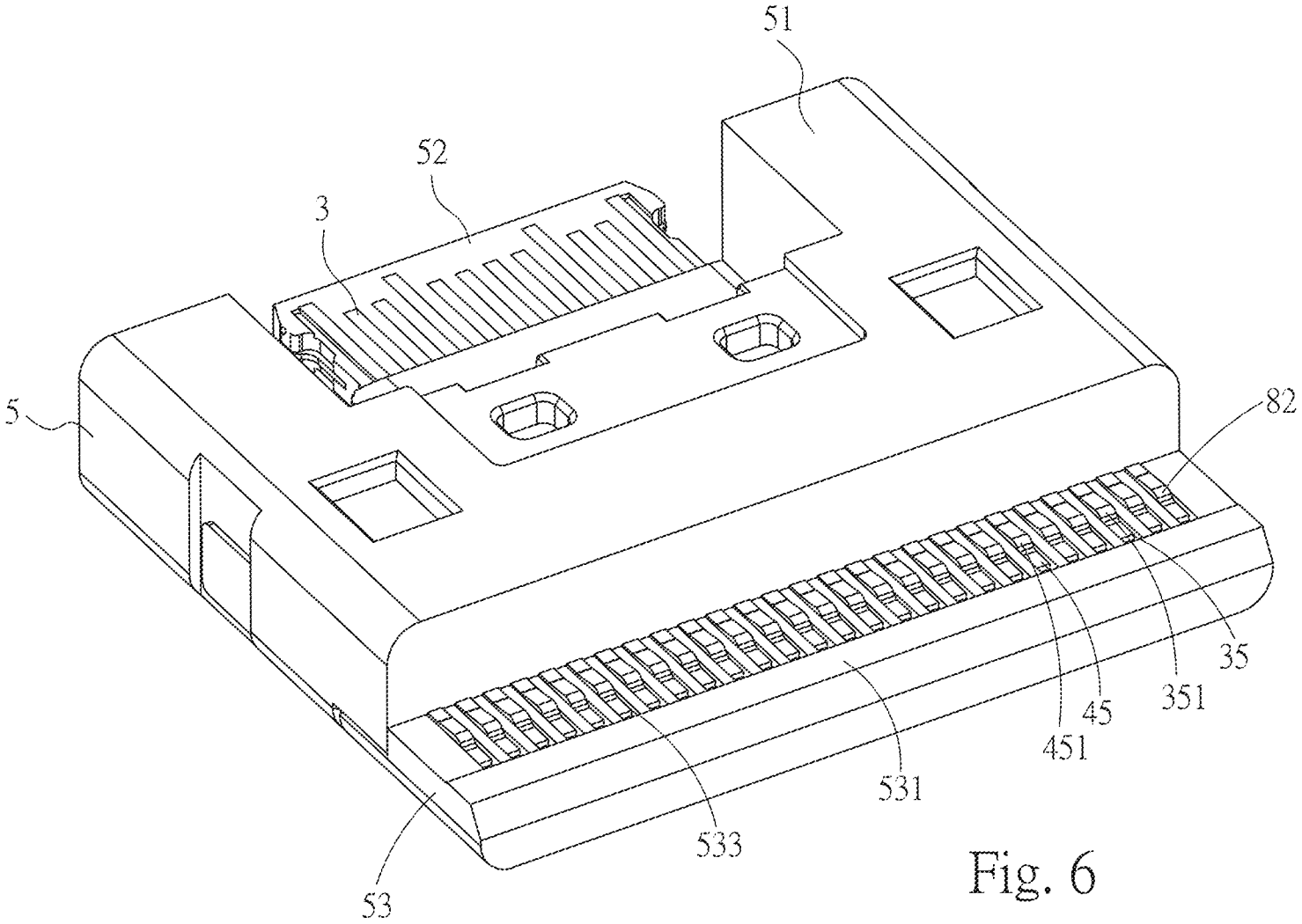
FIG. 6 illustrates a perspective view (2) of the electrical receptacle connector.

Please refer to FIG. 2 and FIGS. 4 to 6. FIG. 6 illustrates a perspective view (2) of the electrical receptacle connector. In this embodiment, each of the first receptacle terminals 3 comprises a flat contact portion 34, a body portion 36, and a tail portion 35. The flat contact portion 34 is extending forward from the body portion 36 in the rear-to-front direction and attached on the first surface of the terminal retaining member 1, and the tail portion 35 is extending backward from the body portion 36 in the front-to-rear direction and extending out of a rear portion of the base portion 51.

Please refer to FIG. 2 and FIGS. 4 to 6. In this embodiment, the first signal terminals 31 are disposed at the tongue portion 52 and transmitting first signals (namely, USB 3.0 signals). Furthermore, each of the tail portions 35 has a first curved surface 351 extending out of the corresponding fixing groove 533. Each of the first curved surfaces 351 is in contact with the corresponding conductive surface 91 of the conductive substrate 9. When the first curved surface 351 is pressed, the first curved surface 351 is moved inwardly toward the fixing groove 533. The tail portions 35 are on the supporting surface 531 of the mount member 53.

Please refer to FIG. 2 and FIGS. 4 to 6. In this embodiment, each of the second receptacle terminals 4 comprises a flat contact portion 44, a body portion 46, and a tail portion 45. The flat contact portion 44 is extending forward from the body portion 46 in the rear-to-front direction and attached on the second surface of the terminal retaining member 1, and the tail portion 45 is extending backward from the body portion 46 in the front-to-rear direction and extending out of the rear portion of the base portion 51.

Please refer to FIG. 2 and FIGS. 4 to 6. In this embodiment, the second signal terminals 41 are disposed at the tongue portion 52 and transmitting second signals (namely, USB 3.0 signals). Furthermore, each of the tail portions 45 has a second curved surface 451 extending out of the corresponding fixing groove 533. Each of the second curved surfaces 451 is in contact with the corresponding conductive surface 91 of the conductive substrate 9. When the second curved surface 451 is pressed, the second curved surface 451 is moved inwardly toward the fixing groove 533.

Please refer to FIG. 2 and FIGS. 4 to 6. In this embodiment, the first receptacle terminals 3 and the second receptacle terminals 4 are substantially parallel with each other. The tail portions 45 of the second receptacle terminals 4 are on the supporting surface 531 of the mount member 53, and the tail portions 35 of the first receptacle terminals 3 and the tail portions 45 of the second receptacle terminals 4 are arranged in a same line. In this embodiment, each of the first receptacle terminals 3 comprises a first extending portion 38 for adjusting a position of the corresponding tail portion 35 to be aligned in the line. Moreover, an insertion space is formed between the embedded member 55 and the supporting surface 531, and the conductive substrate 9 is inserted into the insertion space.

In one embodiment, the electrical receptacle connector 100 may include the first receptacle terminals 3 but exclude the second receptacle terminals 4 (e.g., as a Micro USB connector), and the tail portions 35 of the first receptacle terminals 3 are aligned in a same line.

Please refer to FIGS. 2, 4, 5, and 9. In this embodiment, two opposite ends of each of the first extending portions 38 are respectively connected to the corresponding body portion 36 and the corresponding tail portion 35, and the first extending portion 38 downwardly extends along a vertical direction or a slant direction, so that the tail portions 35 of the first receptacle terminals 3 and the tail portions 45 of the second receptacle terminals 4 are aligned in the same line.

Please refer to FIGS. 1, 2, 7, and 8. In this embodiment, the outer shell 7 encloses the metallic shell 6 and the base portion 51. The outer shell 7 comprises two side plates 71 extending toward two sides of the mount member 53. Each of the side plates 71 has a slidable groove 711. In this embodiment, each of the slidable grooves 711 comprises a first groove 713 and a second groove 714 communicating with the first groove 713, and a width of the first groove 713 is greater than a width of the second groove 714.

Figure 7:
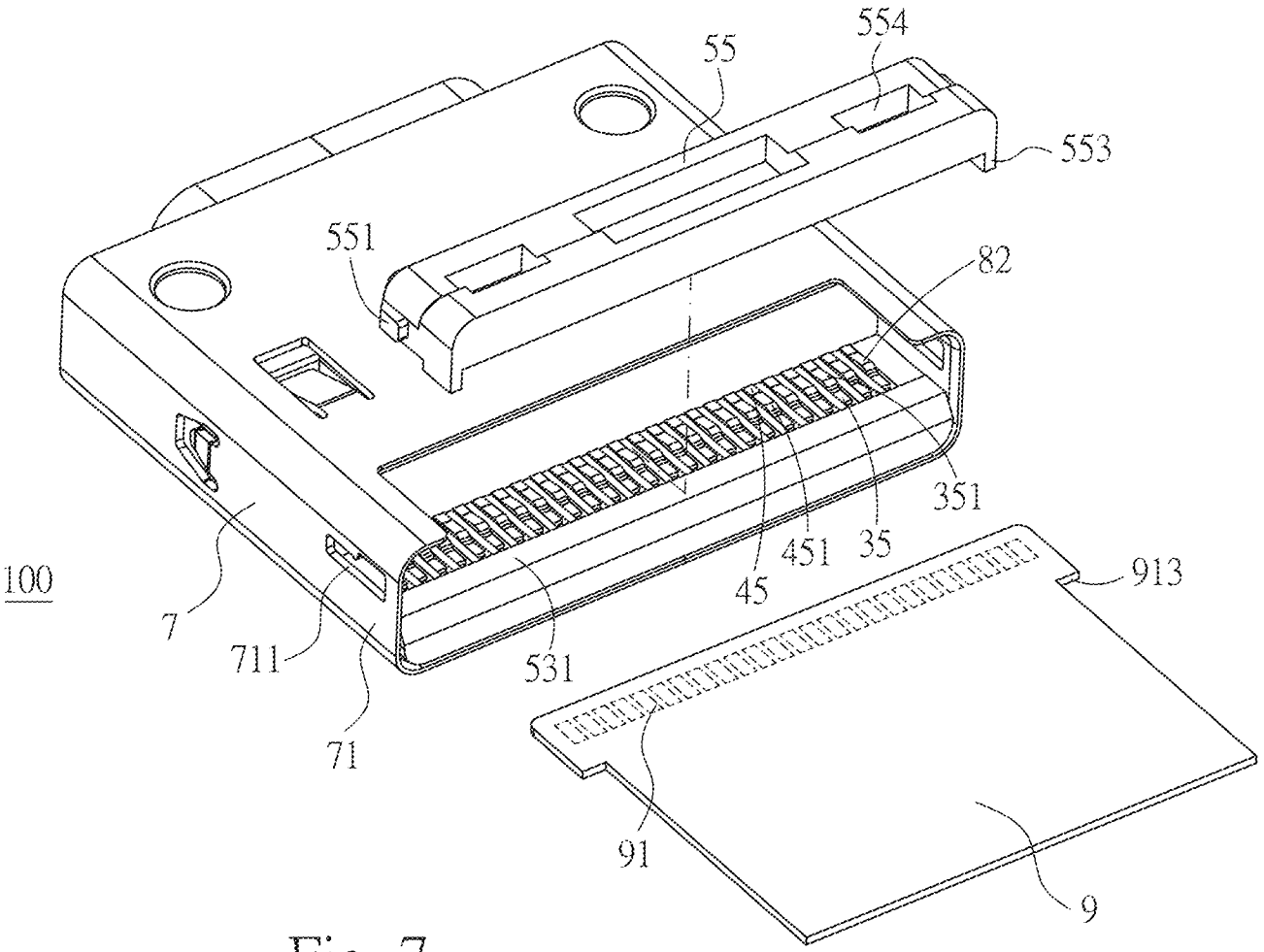
FIG. 7 illustrates an exploded view showing that the connector assembled with an embedded member is to be assembled with a conductive substrate.
Figure 8:
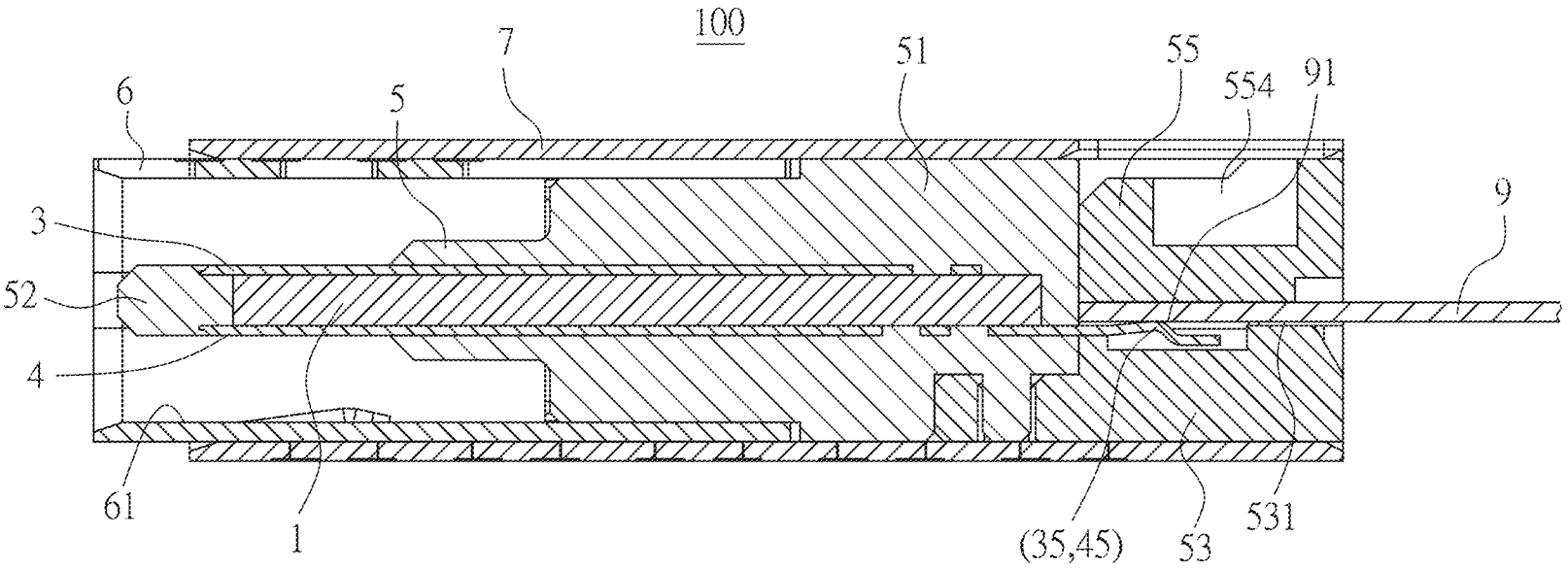
FIG. 8 illustrates a lateral-sectional view of the assembly of the connector, the embedded member, and the conductive substrate.
Figure 10:
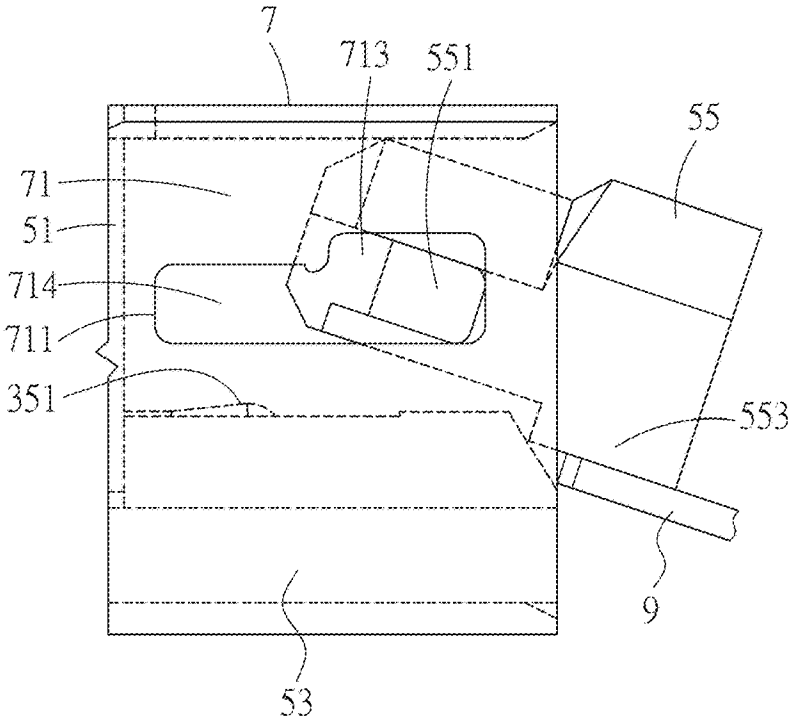
FIG. 10 illustrates a partial lateral-sectional view (1) of the connector, the embedded member, and the conductive substrate.
Figure 9:
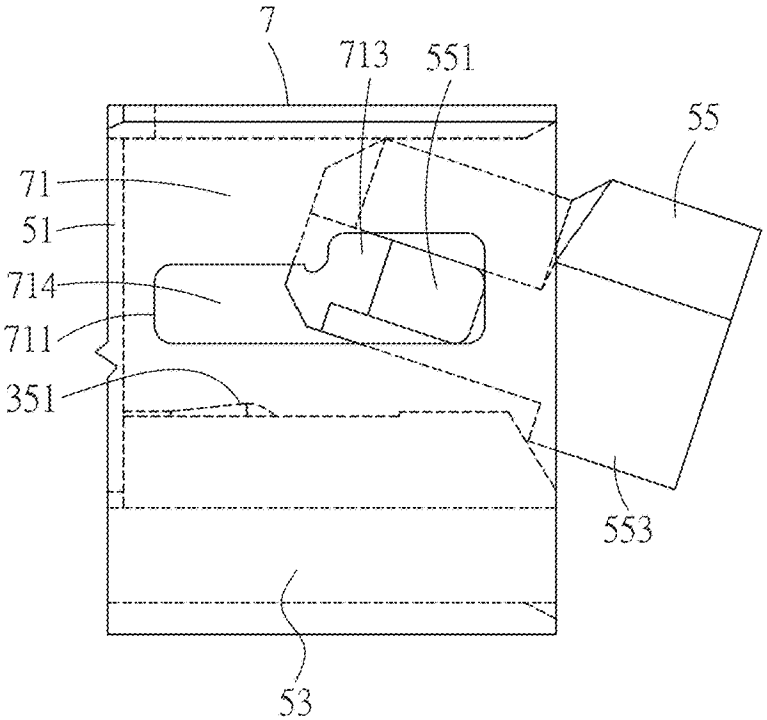
FIG. 9 illustrates a partial lateral-sectional view of the connector and the embedded member.
Figure 12:
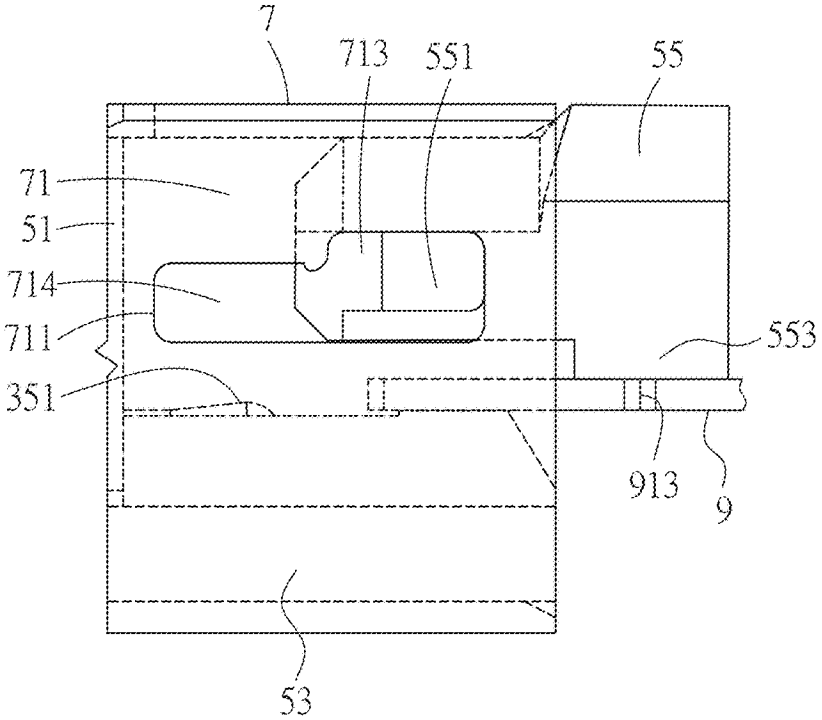
FIG. 12 illustrates a partial lateral-sectional view (3) of the connector, the embedded member, and the conductive substrate.
Figure 11:
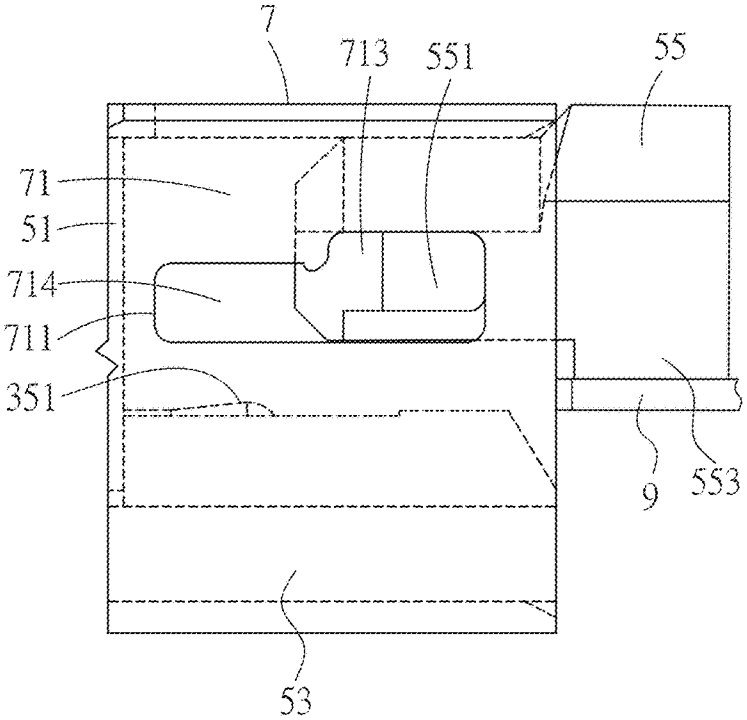
FIG. 11 illustrates a partial lateral-sectional view (2) of the connector, the embedded member, and the conductive substrate.
Figure 14:
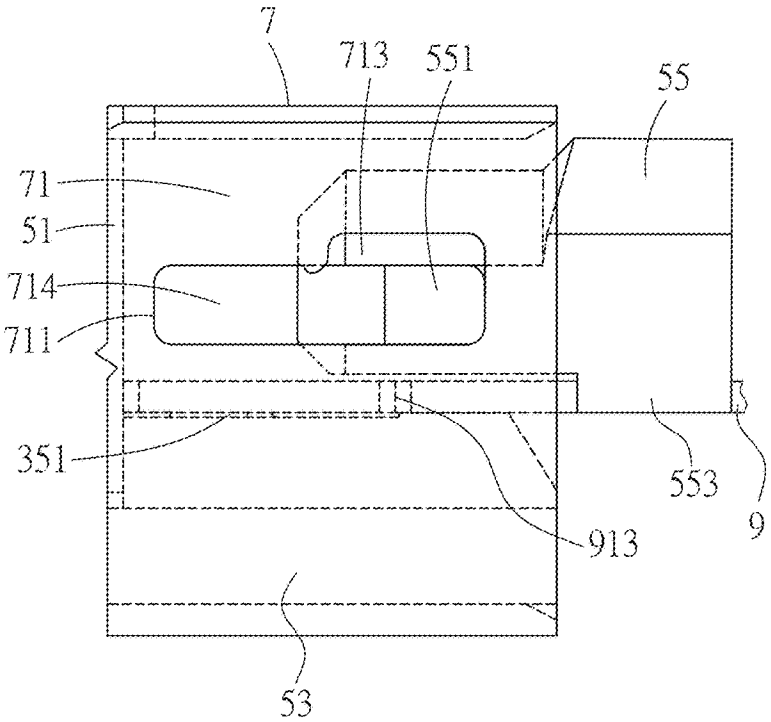
FIG. 14 illustrates a partial lateral-sectional view (5) of the connector, the embedded member, and the conductive substrate.
Figure 13:
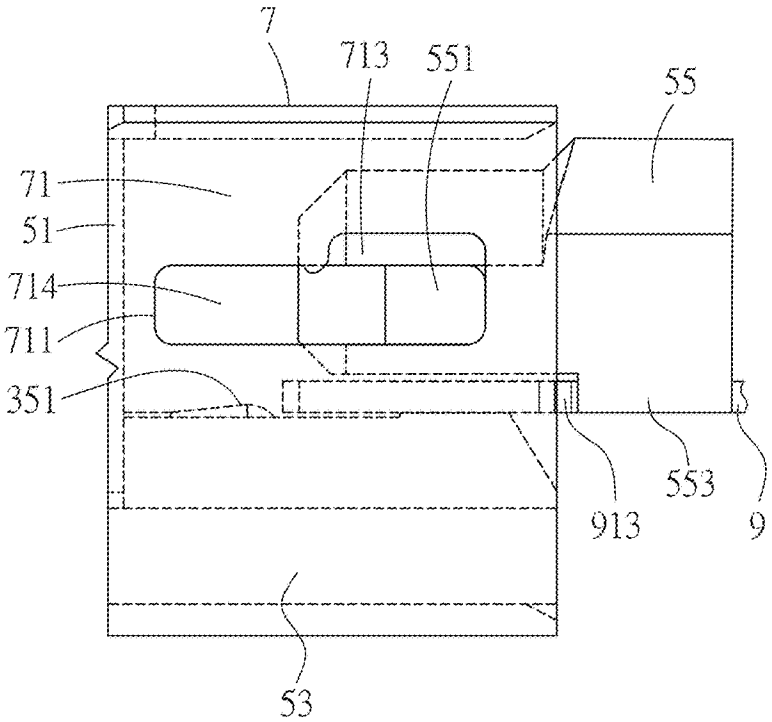
FIG. 13 illustrates a partial lateral-sectional view (4) of the connector, the embedded member, and the conductive substrate.
Figure 15:
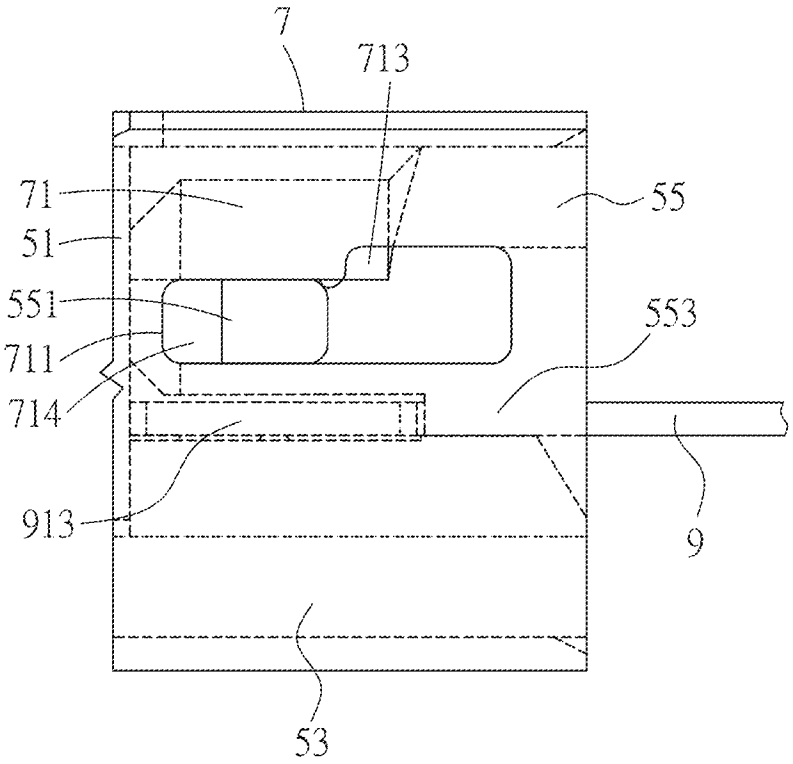
FIG. 15 illustrates a partial lateral-sectional view (6) of the connector, the embedded member, and the conductive substrate.

Please refer to FIGS. 2, 7, and 8. FIG. 8 illustrates a lateral-sectional view of the assembly of the connector, an embedded member 55, and the conductive substrate 9. In this embodiment, the electrical receptacle connector 100 comprises an embedded member 55 between the side plates 71 and placed above the supporting surface 531 of the mount member 53. Two sides of the embedded member 55 have two slidable blocks 551 for engaging with the slidable grooves 711, respectively. A width of the slidable block 551 is substantially equal to the width of the second groove 714. A plurality of stopping blocks 553 is extending outwardly from a bottom of the embedded member 55.

Please refer to FIGS. 9 to 15. Each of the slidable blocks 551 of the embedded member 55 is moved between the first groove 713 and the second groove 714 of the corresponding slidable groove 711. When the conductive substrate 9 is not assembled with the connector, each of the slidable blocks 551 is limited in the corresponding first groove 713, and the rear portion of the embedded member 55 is deflected downwardly. When the conductive substrate 9 is inserted into the connector 100, the conductive substrate 9 is abutted against a bottom portion of the embedded member 55 to push the embedded member 55 upwardly, and each of the buckling portions 913 pushes the corresponding stopping block 553 of the embedded member 55, so that the embedded member 55 is moved upwardly to allow the corresponding slidable block 551 to move to a top portion of the corresponding first groove 713. During the insertion of the conductive substrate 9, when the conductive substrate 9 is not firmly positioned in the connector, the buckling portions 913 are not buckled with the stopping blocks 553, the embedded member 55 is deflected downwardly, and the stopping blocks 553 are buckled with rear portions of the buckling portions 913. Then, the embedded member 55 is inserted into the space between the two side plates 71, and the stopping blocks 553 push the buckling portions 913 to move forward to drive the conductive substrate 9 to be inserted into the connector 100. The embedded member 55 is provided for pushing the conductive substrate 9 forwardly, and the stopping blocks 553 are buckled with the rear portions of the buckling portions 913 for positioning the conductive substrate 9 and preventing the conductive substrate 9 from being detached off the connector 100.

Please refer to FIG. 7. In one embodiment, the buckling portions 913 are extending outwardly from two sides of the conductive substrate 9, and each of the stopping blocks 553 of the embedded member 55 is buckled with the corresponding buckling portion 913. In the insertion of the conductive substrate 9, the movement of the conductive substrate 9 is firstly guided by the structure of the outer shell 7, and the stopping blocks 553 of the embedded member 55 are utilized to precisely align the insertion of the conductive substrate 9. When the conductive substrate 9 is located in the correct position, the embedded member 55 is then placed on the conductive substrate 9 and buckled with the conductive substrate 9.

Please refer to FIGS. 1, 2, and 7. In one embodiment, a plurality of recesses 554 is on a surface of the embedded member 55. Accordingly, when the embedded member 55 is to be detached from the two side plates 71, operators can insert a tool or their fingers into the recesses 554 to tap the embedded member 55 outwardly.

Please refer to FIGS. 2, 4, 5, and 6, from a top view of the receptacle terminals, the alignment may be in an order of a tail portion 35, a tail portion 45, another tail portion 35, and another tail portion 45, the alignment may be in an order of a tail portion 35, a tail portion 45, another tail portion 45, and another tail portion 35, or the alignment may be in an order of a tail portion 35, another tail portion 35, a tail portion 45, and another tail portion 45.

Please refer to FIGS. 2 to 4. In this embodiment, twelve first receptacle terminals 3 are provided for transmitting USB 3.0 signals. From a front view of the first receptacle terminals 3, the first receptacle terminals 3 comprise, from left to right, a ground terminal 33 (Gnd), a first pair of first high-speed signal terminals (TX1+−, differential signal terminals for high-speed signal transmission), a power terminal 32 (Power/VBUS), a first function detection terminal (CC1, a terminal for inserting orientation detection of the connector and for cable recognition), a pair of first low-speed signal terminals 311 (D+−, differential signal terminals for low-speed signal transmission), a first supplement terminal (SBU1, a terminal can be reserved for other purposes), another power terminal 32 (Power/VBUS), a second pair of first high-speed signal terminals (RX2+−, differential signal terminals for high-speed signal transmission), and another ground terminal 33 (Gnd). In this embodiment, each pair of the first high-speed signal terminals is between the corresponding power terminal 32 and the adjacent ground terminal 33, and the pair of the first low-speed signal terminals 311 is between the first function detection terminal and the first supplement terminal.

In some embodiments for transmitting USB 3.0 signals, the rightmost ground terminal 33 (Gnd) (or the leftmost ground terminal 33 (Gnd)) or the first supplement terminal (SBU1) can be further omitted. Therefore, the total number of the first receptacle terminals 3 can be reduced from twelve terminals to seven terminals.

Furthermore, in some embodiments, the first receptacle terminals 3 comprise a plurality of first signal terminals 31, at least one power terminal 32, and at least one ground terminal 33. The first signal terminals 31 comprise a pair of first low-speed signal terminals 311. In other words, the first receptacle terminals 3 comprise a pair of ground terminals 33 (Gnd), a power terminal 32 (Power/VBUS), a first function detection terminal (CC1/CC2, a terminal for inserting orientation detection of the connector and for cable recognition), a pair of first low-speed signal terminals 311 (D+−, differential signal terminals for low-speed signal transmission), and a first supplement terminal (SBU1/SBU2, a terminal can be reserved for other purposes). In this embodiment, seven first receptacle terminals 3 are provided for transmitting USB 2.0 signals.

Furthermore, the ground terminal 33 (Gnd) may be replaced by a power terminal 32 (Power/VBUS) and provided for power transmission. In this embodiment, the width of the power terminal 32 (Power/VBUS) may be, but not limited to, equal to the width of the first signal terminal 31. In some embodiments, the width of the power terminal 32 (Power/VBUS) may be greater than the width of the first signal terminal 31 and an electrical receptacle connector 100 having the power terminal 32 (Power/VBUS) can be provided for large current transmission.

Please refer to FIGS. 2 to 4. In this embodiment, twelve second receptacle terminals 4 are provided for transmitting USB 3.0 signals. From a front view of the second receptacle terminals 4, the second receptacle terminals 4 comprise, from right to left, a ground terminal 43 (Gnd), a first pair of second high-speed signal terminals (TX2+−, differential signal terminals for high-speed signal transmission), a power terminal 42 (Power/VBUS), a second function detection terminal (CC2, a terminal for inserting orientation detection of the connector and for cable recognition), a pair of second low-speed signal terminals 411 (D+−, differential signal terminals for low-speed signal transmission), a second supplement terminal (SBU2, a terminal can be reserved for other purposes), another power terminal 42 (Power/VBUS), a second pair of second high-speed signal terminals (RX1+−, differential signal terminals for high-speed signal transmission), and another ground terminal 43 (Gnd).

In this embodiment, each pair of the second high-speed signal terminals is between the corresponding power terminal 42 and the adjacent ground terminal 43, and the pair of the second low-speed signal terminals 411 is between the second function detection terminal and the second supplement terminal.

In some embodiments for transmitting USB 3.0 signals, the rightmost ground terminal 43 (Gnd) (or the leftmost ground terminal 43 (Gnd)) or the second supplement terminal (SBU2) can be further omitted. Therefore, the total number of the second receptacle terminals 4 can be reduced from twelve terminals to seven terminals.

Furthermore, in some embodiments, the second receptacle terminals 4 comprise a plurality of second signal terminals 41, at least one power terminal 42, and at least one ground terminal 43. The second signal terminals 41 comprise a pair of second low-speed signal terminals 411. In other words, the second receptacle terminals 4 comprise a pair of ground terminals 43 (Gnd), a power terminal 42 (Power/VBUS), a second function detection terminal (CC1/CC2, a terminal for inserting orientation detection of the connector and for cable recognition), a pair of second low-speed signal terminals 411 (D+−, differential signal terminals for low-speed signal transmission), and a second supplement terminal (SBU1/SBU2, a terminal can be reserved for other purposes). In this embodiment, seven second receptacle terminals 4 are provided for transmitting USB 2.0 signals.

Furthermore, the ground terminal 43 (Gnd) may be replaced by a power terminal 42 (Power/VBUS) and provided for power transmission. In this embodiment, the width of the power terminal 42 (Power/VBUS) may be, but not limited to, equal to the width of the second signal terminal 41. In some embodiments, the width of the power terminal 42 (Power/VBUS) may be greater than the width of the second signal terminal 41 and an electrical receptacle connector 100 having the power terminal 42 (Power/VBUS) can be provided for large current transmission.

Please refer to FIGS. 2, 5, 6, and 8. In this embodiment, the first receptacle terminals 3 and the second receptacle terminals 4 are disposed upon the upper surface and the lower surface of the tongue portion 52, respectively, and pin-assignments of the first receptacle terminals 3 and the second receptacle terminals 4 are point-symmetrical with a central point of the receptacle cavity 61 of the metallic shell 6 as the symmetrical center. In other words, pin-assignments of the first receptacle terminals 3 and the second receptacle terminals 4 have 180-degree symmetrical design with respect to the central point of the receptacle cavity 61 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 3 (or the second receptacle terminals 4), are rotated by 180 degrees with the symmetrical center as the rotating center, the first receptacle terminals 3 and the second receptacle terminals 4 are overlapped. That is, the rotated first receptacle terminals 3 are arranged at the position of the original second receptacle terminals 4, and the rotated second receptacle terminals 4 are arranged at the position of the original first receptacle terminals 3. In other words, the first receptacle terminals 3 and the second receptacle terminals 4 are arranged upside down, and the pin assignments of the first receptacle terminals 3 are left-right reversal with respect to that of the second receptacle terminals 4. An electrical plug connector is inserted into the electrical receptacle connector 100 with a first orientation where the upper surface of the tongue portion 52 is facing up, for transmitting first signals. Conversely, the electrical plug connector is inserted into the electrical receptacle connector 100 with a second orientation where the upper surface of the tongue portion 52 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 3 (or the second receptacle terminals 4) when an electrical plug connector to be mated with the electrical receptacle connector 100 has upper and lower plug terminals. In the case that the first receptacle terminals 3 are omitted, the upper plug terminals or the lower plug terminals of the electrical plug connector are in contact with the second receptacle terminals 4 of the electrical receptacle connector 100 when the electrical plug connector is inserted into the electrical receptacle connector 100 with the dual orientations. Conversely, in the case that the second receptacle terminals 4 are omitted, the upper plug terminals or the lower plug terminals of the electrical plug connector are in contact with the first receptacle terminals 3 of the electrical receptacle connector 100 when the electrical plug connector is inserted into the electrical receptacle connector 100 with the dual orientations.

Please refer to FIGS. 2, 5, and 6. In this embodiment, as viewed from the front of the receptacle terminals 3, 4, the position of the first receptacle terminals 3 corresponds to the position of the second receptacle terminals 4. In other words, the positions of the flat contact portions 34 are respectively aligned with the positions of the flat contact portions 44, but embodiments are not limited thereto. In some embodiments, the first receptacle terminals 3 may be aligned by an offset with respect to the second receptacle terminals 4. That is, the flat contact portions 34 are aligned by an offset with respect to the flat contact portions 44. Accordingly, because of the offset alignment of the flat contact portions 34, 45, the crosstalk between the first receptacle terminals 3 and the second receptacle terminals 4 can be reduced during signal transmission. It is understood that, when the receptacle terminals 3, 4 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 3, 4 of the electrical receptacle connector 100 for power or signal transmission.

Please refer to FIG. 2 and FIGS. 4 to 6. In this embodiment, the electrical receptacle connector 100 further comprises a plurality of shielding plates 8. In the first molding procedure, the shielding plates 8 are at two sides of the terminal retaining member 1, and each of the shielding plates 8 is between the ground terminal 33 and the ground terminal 43. After the second molding procedure, the shielding plates 8 and the terminal retaining member 1 are disposed in the tongue portion 52. In this embodiment, a space 83 is between the shielding plates 8. The first low-speed signal terminals 311 and the second low-speed signal terminals 411 are respectively at upper and lower sides of the space 83, i.e., the space 83 is between the first low-speed signal terminals 311 and the second low-speed signal terminals 411. Furthermore, in this embodiment, the overall width of the first low-speed signal terminals 311 is approximately equal to the distance of the space 83, and the overall width of the second low-speed signal terminals 411 is approximately equal to the distance of the space 83. It is understood that, in this embodiment, the connector comprises several shielding plates, but embodiments are not limited thereto. In some embodiments, the connector may comprise one shielding plate.

Please refer to FIG. 2 and FIGS. 4 to 6. The shielding plate 8 comprises a plate body and a plurality of legs 82. The plate body is between the flat contact portions 34 of the first receptacle terminals 3 and the flat contact portions 44 of the second receptacle terminals 4. Specifically, the plate body may be lengthened and widened, so that the front of the plate body is near a front lateral surface of the tongue portion 52, two sides of the plate body is near two sides of the tongue portion 52 for contacting an electrical plug connector, and the rear of the plate body is near the rear of the tongue portion 52. Accordingly, the plate body can be disposed on the tongue portion 52 and the base portion 51, and the structural strength of the tongue portion 52 and the shielding performance of the tongue portion 52 can be improved. The edge of the plate body is extending out of the outer lateral surface of the base portion 51 for contacting the outer shell 7 to have conduction and grounding performances.

Please refer to FIGS. 2 to 5. The legs 82 of the shielding plate 8 are downwardly extending from the rear portion of the plate body to form flat legs. That is, the legs 82 are at two outermost sides of the receptacle terminals 3, 4 are exposed from the base portion 51 and soldered with the conductive substrate 9. In this embodiment, the crosstalk interference can be reduced by the shielding of the shielding plate 8 when the flat contact portions 34, 45 transmit signals. Furthermore, the structural strength of the tongue portion 52 can be improved by the assembly of the shielding plate 8. In addition, the legs 82 of the shielding plate 8 are exposed from the base portion 51 and soldered with the conductive substrate 9 for conduction and grounding.

Please refer to FIGS. 2 to 5. The shielding plate 8 further comprises a plurality of hooks. The hooks are extending outwardly from two sides of the front portion of the plate body and protruding from the front lateral surface and two sides of the tongue portion 52. In other words, the hooks are respectively outwardly protruding from two sides of the front portion of the shielding plate 8, and the hooks are protruding from the two sides of the front portion of the tongue portion 52. A front end of the first receptacle terminal 3 above the hook is spaced from a front end of the hook by a distance, and a front end of the second receptacle terminal 4 below the hook is spaced from a front end of the hook by a distance. In other words, the front ends of the first receptacle terminals 3 and the front ends of the respective hooks have a distance in a horizontal direction, and the front ends of the second receptacle terminals 4 and the front ends of the respective hooks have a distance in the horizontal direction. That is, the hooks are protruding from the front end of the tongue portion 52, while the front ends of the first receptacle terminals 3 and the front ends of the second receptacle terminals 4 are not protruding from the front end of the tongue portion 52. Therefore, the hooks protect the front end of the tongue portion 52 from being worn after the connector is used for a period of time and the hooks further prevent the front ends of the first receptacle terminals 3 and the front ends of the second receptacle terminals 4 from impacting with each other when the front end of the tongue portion 52 is worn. Furthermore, when an electrical plug connector is mated with the electrical receptacle connector 100, elastic pieces at two sides of an insulated housing of the electrical plug connector are engaged with the hooks, and the elastic pieces would not wear against the tongue portion 52 of the electrical receptacle connector 100.

Please refer to FIGS. 1 to 3. It is understood that, when the connector has a number of receptacle terminals adapted to transmit USB 2.0 signals (i.e., transmit low-speed signals) or has a number of receptacle terminals adapted to transmit USB 3.0 signals (i.e., transmit high-speed signals), the connector may comprise the shielding plate 8. When the shielding plate 8 is provided for a connector for USB 3.0 signal transmission, the shielding plate 8 can provide a shielding function to prevent crosstalk between terminals, the shielding plate 8 is also adapted to be engaging with an electrical plug connector, and the shielding plate 8 is further provided for grounding. Conversely, when the shielding plate 8 is provided for a connector for USB 2.0 signal transmission, the shielding plate 8 is adapted to be engaged with an electrical plug connector, and the shielding plate 8 is further provided for grounding.

As above, the mount member is assembled at the rear portion of the insulated housing for positioning the conductive substrate, and the tail portions on the mount member are in contact with the conductive surfaces of the conductive substrate. Hence, the electrical receptacle connector can be connected with the conductive substrate without connecting to an additional FPC receptacle connector and additional terminals of the FPC connector. Consequently, a product with the connector can be assembled with flexible circuit board or flexible flat cables, and the circuit board or cable can be replaced easily when the board or the cable has defects. Moreover, the outer shell out of the insulated housing comprises the two side plates extending toward the two sides of the mount member, so that the conductive substrate can be inserted into the connector through the space between the two side plates in a convenient manner. Furthermore, the embedded member is adapted to fix the conductive substrate and prevents the conductive substrate being detached from the connector.

Furthermore, when the terminal retaining member is formed in the first molding procedure, the first receptacle terminals are positioned on the first surface of the terminal retaining member and the second receptacle terminals are positioned on the second surface of the terminal retaining member. After the receptacle terminals are assembled with the terminal retaining member, the assembly is placed in the mold for a second molding procedure, so that the insulated housing is formed out of the terminal retaining member, and a semi-product of the connector can be thus obtained. As compared with the conventional, the molding times for the connector can be reduced, from three times to two times. Therefore, the difficulties in manufacturing the components of the connector and the cost for manufacturing the connector can be reduced, while the manufacturing efficiency of the connector can be improved. Moreover, in the second molding procedure, the first receptacle terminals and the second receptacle terminals are molded by the insulated housing. Therefore, the front ends of the receptacle terminals would not deflect upwardly when the connector is used for a period of time. Furthermore, the terminal retaining member is adapted to separate the first receptacle terminals, the second receptacle terminals, and the shielding plate to prevent interferences between the components.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, adapted to be in contact with a plurality of conductive surfaces of a conductive substrate, wherein the electrical receptacle connector comprises:

a terminal retaining member;

an insulated housing formed out of the terminal retaining member, wherein the insulated housing comprises a base portion and a tongue portion, the tongue portion is extending from one of two ends of the base portion, and a mount member is assembled at an other end of the base portion;

a plurality of first receptacle terminals, wherein each of the first receptacle terminals comprises a first flat contact portion, a first body portion, and a first tail portion, each of the first flat contact portions is extending forward from the first body portion in a rear-to-front direction and on a first surface of the terminal retaining member, each of the first tail portions is extending backward from the first body portion in a front-to-rear direction and extending out of the base portion, and the first tail portions are on the mount member and in contact with the conductive surfaces;

an outer shell enclosing out of the base portion, wherein the outer shell comprises two side plates respectively extending in a direction in which two sides of the mount member extend, each of the side plates has a slidable groove; and an embedded member between the side plates and on the mount member, wherein two sides of the embedded member have two slidable blocks for engaging with the slidable grooves, respectively, and a plurality of stopping blocks is extending outwardly from a bottom of the embedded member.

2. The electrical receptacle connector according to claim 1, wherein each of the slidable grooves comprises a first groove and a second groove communicating with the first groove, wherein a width of the first groove is greater than a width of the second groove, and a width of the slidable block is substantially equal to the width of the second groove.

3. The electrical receptacle connector according to claim 1, wherein two buckling portions are outwardly protruding from two sides of the conductive substrate, and the stopping blocks of the embedded member are buckled with the buckling portions, respectively.

4. The electrical receptacle connector according to claim 1, wherein a plurality of recesses is on a surface of the embedded member.

5. The electrical receptacle connector according to claim 1, wherein each of the first receptacle terminals comprises a first extending portion for adjusting a position of the corresponding first tail portion.

6. The electrical receptacle connector according to claim 5, further comprising a plurality of second receptacle terminals, wherein each of the second receptacle terminals comprises a second flat contact portion, a second body portion, and a second tail portion, each of the second flat contact portions is extending forward from the second body portion in the rear-to-front direction and on a second surface of the terminal retaining member opposite to the first surface, each of the second tail portions is extending backward from the second body portion in the front-to-rear direction and extending out of the base portion, the second tail portions are on the mount member and in contact with the conductive surfaces, and the first tail portions and the second tail portions are arranged in a same line.

7. The electrical receptacle connector according to claim 6, wherein a plurality of fixing grooves is formed on a surface of the mount member, and the first tail portions and the second tail portions are held in the fixing grooves, respectively.

8. The electrical receptacle connector according to claim 7, wherein each of the first tail portions has a first curved surface extending out of the corresponding fixing groove, and each of the second tail portions has a second curved surface extending out of the corresponding fixing groove.

9. The electrical receptacle connector according to claim 6, further comprising a plurality of shielding plates, the shielding plates are at two sides of the terminal retaining member, and the shielding plates are between the first receptacle terminals and the second receptacle terminals.

10. The electrical receptacle connector according to claim 1, further comprising a metallic shell, wherein the metallic shell comprises a receptacle cavity for receiving the tongue portion.

11. The electrical receptacle connector according to claim 9, wherein an overall width of first low-speed signal terminals of the first receptacle terminals is approximately equal to a distance between the shielding plates, and an overall width of second low-speed signal terminals of the second receptacle terminals is approximately equal to the distance between the shielding plates.

* * * * *